US010220637B2

(12) United States Patent
Sasaki

(10) Patent No.: US 10,220,637 B2
(45) Date of Patent: Mar. 5, 2019

(54) LIQUID DISCHARGE APPARATUS

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 60 days.

(21) Appl. No.: 15/205,185

(22) Filed: Jul. 8, 2016

(65) Prior Publication Data

US 2017/0015114 A1 Jan. 19, 2017

(30) Foreign Application Priority Data

Jul. 13, 2015 (JP) ..... 2015-139633

(51) Int. Cl.
*B41J 11/00* (2006.01)

(52) U.S. Cl.
CPC ..... *B41J 11/0015* (2013.01)

(58) Field of Classification Search
CPC .... B41J 2/2114; B41J 11/0015; B41J 2/2107; B41J 29/38; B41J 2/16552
USPC ..... 347/21, 95, 100
See application file for complete search history.

(56) References Cited

U.S. PATENT DOCUMENTS

2004/0090508 A1 5/2004 Chowdry et al.
2006/0066662 A1* 3/2006 Kadomatsu ..... B41J 11/0015 347/21
2011/0069104 A1 3/2011 Tsuzawa
2011/0304661 A1* 12/2011 Emamjomeh ..... C09D 11/54 347/1
2013/0215194 A1* 8/2013 Leoni ..... B41J 2/1652 347/34
2014/0043393 A1 2/2014 Takeuchi
2016/0114599 A1 4/2016 Suzuki

FOREIGN PATENT DOCUMENTS

JP 2003-136689 5/2003
JP 2012-200905 10/2012
JP 2014-034167 2/2014
JP 2015-024649 2/2015

OTHER PUBLICATIONS

European Search Report for Application No. 16178257.8 dated Feb. 24, 2017.

* cited by examiner

*Primary Examiner* — Jannelle M Lebron
(74) *Attorney, Agent, or Firm* — Workman Nydegger

(57) ABSTRACT

A liquid discharge apparatus includes a liquid discharge section for discharging a liquid containing agglomerate components having a polarity toward a medium and at least one ion supplying section for supplying ions having a polarity opposite to that of the agglomerate components to the liquid discharged on the medium. The liquid discharge apparatus of such a structure can suppress the unevenness caused by contact of dots of the liquid discharged on the medium. The liquid apparatus can prevent or reduce contact between dots of the liquid discharged on the medium.

9 Claims, 9 Drawing Sheets

LIQUID DISCHARGE APPARATUS

The entire disclosure of Japanese Patent Application No: 2015-139633, filed Jul. 13, 2015 is expressly incorporated by reference herein in its entirety.

BACKGROUND

1. Technical Field

Embodiments of the present invention relate to a liquid discharge apparatus.

2. Related Art

Liquid discharge apparatuses for discharging liquid such as ink toward a medium have been used. These liquid discharge apparatuses are controlled such that each dot of liquid is discharged onto the medium with a desired size using various techniques. For example, JP-A-2014-34167 discloses a liquid discharge apparatus (ink jet printer) capable of applying a pretreatment liquid that has a function of agglomerating color material components of ink to the medium.

However, with the further increase in productivity (the increase in recording speeds) of recent liquid discharge apparatuses (recording apparatuses) such as a liquid discharge apparatus that forms an image by discharging ink, or the like, it has become difficult to control the desired size of each dot of liquid discharged onto the medium using known techniques. Because the desired size of the discharged liquid dots on the medium is poorly controlled, the liquid dots discharged onto the medium come into contact with each other, which causes unevenness.

SUMMARY

An advantage of some aspects of the invention is that the unevenness caused by the contact of liquid dots discharged onto a medium can be suppressed.

In order to solve the aforementioned problem, a liquid discharge apparatus according to a first aspect of the invention includes a liquid discharge section for discharging a liquid containing agglomerate components having a polarity toward a medium. The liquid discharge section may have at least one ion supplying section for supplying ions having a polarity opposite to that of the agglomerate components toward the liquid discharged onto the medium.

According to this aspect, at least one ion supplying section for supplying ions having a polarity opposite to that of the agglomerate components of the liquid discharged on the medium is provided. Consequently, a skin layer can be formed by agglomerating agglomerate components with the ions on the surface of each dot of the liquid discharged on the medium. The formed skin layer can prevent each dot of the liquid discharged on the medium from exceeding a desired size and can prevent the dots from coming into contact with each other. In other words, the unevenness due to contact of the dots of the liquid discharged on the medium can be suppressed. For example, the "agglomerate components having a polarity" may be coloring materials (pigments or dyes) in a case where the liquid is an ink, or polymer components such as latex. Furthermore, the "ion supplying section for supplying ions having the polarity opposite to that of the agglomerate components" may be, for example, an ionizer, and the like, and the ionizer is capable of supplying positive ions if the agglomerate components are anionic color materials.

The liquid discharge apparatus of a second aspect of the invention, according to the first aspect, may further include a pretreatment agent supplying section for supplying a pretreatment agent containing components having the polarity opposite to that of the agglomerate components to the medium prior to the discharge of the liquid.

According to this aspect, a pretreatment agent supplying section for supplying a pretreatment agent containing components having the polarity opposite to that of the agglomerate components to the medium prior to the discharge of the liquid is provided. Consequently, the effect of suppressing the spread of the dots can be further increased. Accordingly, the unevenness due to contact of the dots of the liquid discharged on the medium can be effectively suppressed.

The liquid discharge apparatus of a third aspect of the invention, according to the first aspect, may further include a transport section for transporting the medium, and a moving section configured to reciprocate together with the liquid discharge section in directions intersecting a transport direction of the medium. The ion supplying section may be provided on the moving section.

According to this aspect, the liquid discharge apparatus is a so-called serial type liquid discharge apparatus that moves the liquid discharge section in the directions intersecting the transport direction, and the ion supplying section may be provided on the moving section. Consequently, immediately after the liquid is discharged toward the medium, the ions can be supplied. Consequently, the unevenness caused by contact of the dots of the liquid discharged on the medium can be effectively suppressed.

In the liquid discharge apparatus of a fourth aspect of the invention, according to the third aspect, the ion supplying section may be provided on a downstream side of the moving direction of the liquid discharge section discharging the liquid among the intersecting directions with respect to the liquid discharge section.

According to this aspect, the ion supplying section may be provided on a downstream side of the moving direction of the liquid discharge section discharging the liquid among the intersecting directions with respect to the liquid discharge section. Consequently, the structure capable of supplying the ions to the liquid discharged on the medium, that is, the structure capable of supplying the ions to the liquid discharged on the medium after the liquid is discharged on the medium from the liquid discharge section can be readily provided.

In the liquid discharge apparatus of a fifth aspect of the invention, according to the fourth aspect, the ion supplying sections may be provided on two sides in the intersecting directions with respect to the liquid discharge section.

According to this aspect, the ion supplying sections may be provided on two sides in the intersecting directions with respect to the liquid discharge section. Consequently, in both directions of the intersecting directions, while the liquid is being discharged, the ions can be supplied to the discharged liquid. In other words, the unevenness due to contact of the dots of the liquid discharged on the medium can be suppressed with high productivity. Furthermore, with the liquid discharge section and the ion supplying sections arranged in the intersecting directions, the ions can be supplied immediately after the discharge of the liquid.

In the liquid discharge apparatus of a sixth aspect of the invention, according to the first aspect, the ion supplying section may be provided on the downstream side in a transport direction of the medium with respect to the liquid discharge section.

According to this aspect, the ion supplying section may be provided on the downstream side in a transport direction with respect to the liquid discharge section. Consequently, the structure capable of supplying the ions to the liquid discharged on the medium, that is, the structure capable of supplying ions to the liquid discharged on the medium after the liquid is discharged on the medium from the liquid discharge section can be readily provided.

The liquid discharge apparatus of a seventh aspect of the invention, according to the first aspect, may further include at least one pretreatment agent supplying section for supplying a pretreatment agent containing components having the polarity opposite to that of the agglomerate components to the medium prior to the discharge of the liquid, a transport section for transporting the medium, and a moving section configured to reciprocate together with the liquid discharge section in directions which intersect a transport direction of the medium. The ion supplying section and the pretreatment agent supplying section may be provided on the moving section. The ion supplying section may be provided, with respect to the liquid discharge section, on at least one of the downstream side of the transport direction and the downstream side of the moving direction of the liquid discharge section discharging the liquid among the intersecting directions. The pretreatment agent supplying section may be provided, with respect to the liquid discharge section, on at least one of the upstream side of the transport direction and the upstream side of the moving direction of the liquid discharge section discharging the liquid among the intersecting directions.

According to this aspect, the liquid discharge apparatus is a so-called serial type liquid discharge apparatus, and the ion supplying section and the pretreatment agent supplying section may be provided on the moving section. Consequently, immediately after the pretreatment agent is discharged toward the medium, the liquid can be discharged toward the medium, and then, the ions can be supplied. Consequently, the unevenness caused by contact of the dots of the liquid discharged on the medium can be further effectively suppressed.

In the liquid discharge apparatus of an eighth aspect of the invention, according to the seventh aspect, the pretreatment agent supplying sections may be provided on two sides in the intersecting directions with respect to the liquid discharge section.

According to this aspect, the pretreatment agent supplying sections may be provided on two sides in the intersecting directions with respect to the liquid discharge section. Consequently, in two directions of the intersecting directions, while the pretreatment agent is being supplied, the liquid can be discharged. In other words, the unevenness due to contact of dots of the liquid discharged on the medium can be suppressed with high productivity. Furthermore, with the liquid discharge section and the pretreatment agent supplying sections arranged in the intersecting directions, the liquid can be discharged immediately after the supply of the pretreatment agent.

In the liquid discharge apparatus of a ninth aspect of the invention, according to the seventh aspect, the pretreatment agent supplying section may be provided on the upstream side of the transport direction with respect to the liquid discharge section.

According to this aspect, the pretreatment agent supplying section may be provided on the upstream side of the transport direction with respect to the liquid discharge section. Consequently, in the two directions of the intersecting directions, while the pretreatment agent is being supplied, the liquid can be discharged. In other words, the unevenness due to contact of the dots of the liquid discharged on the medium can be suppressed with high productivity. Furthermore, the necessity for providing the pretreatment agent supplying sections at two sides of the liquid discharge section can be eliminated. Consequently it is possible to constrain both the size (or suppress the increase in size) of the apparatus and the cost of the apparatus.

In the liquid discharge apparatus of a tenth aspect of the invention, according to the first aspect, the liquid discharge apparatus can form a plurality of layers by discharging the liquid from the liquid discharge section.

For example, in a case where the liquid discharge apparatus includes the pretreatment agent supplying section and is capable of forming a plurality of layers by discharging the liquid from the liquid discharge section, the liquid discharge apparatus discharges the liquid to form a plurality of layers on an area in which the pretreatment agent has been supplied. Consequently, with the liquid discharge apparatus of such a structure, it is difficult to suppress the unevenness due to contact of the dots of the liquid discharged on the medium because the pretreatment agent does not fully work on the upper layers.

The liquid discharge apparatus according to this aspect, however, includes the ion supplying section that supplies ions having the polarity opposite to that of the agglomerate components to the liquid discharged on the medium. Consequently, the unevenness caused by contact of the liquid dots discharged on the medium can be suppressed.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, recording apparatuses according to the embodiments of the liquid discharge apparatus of the invention will be described.

First Embodiment (FIGS. 1 to 7)

Figure 1:
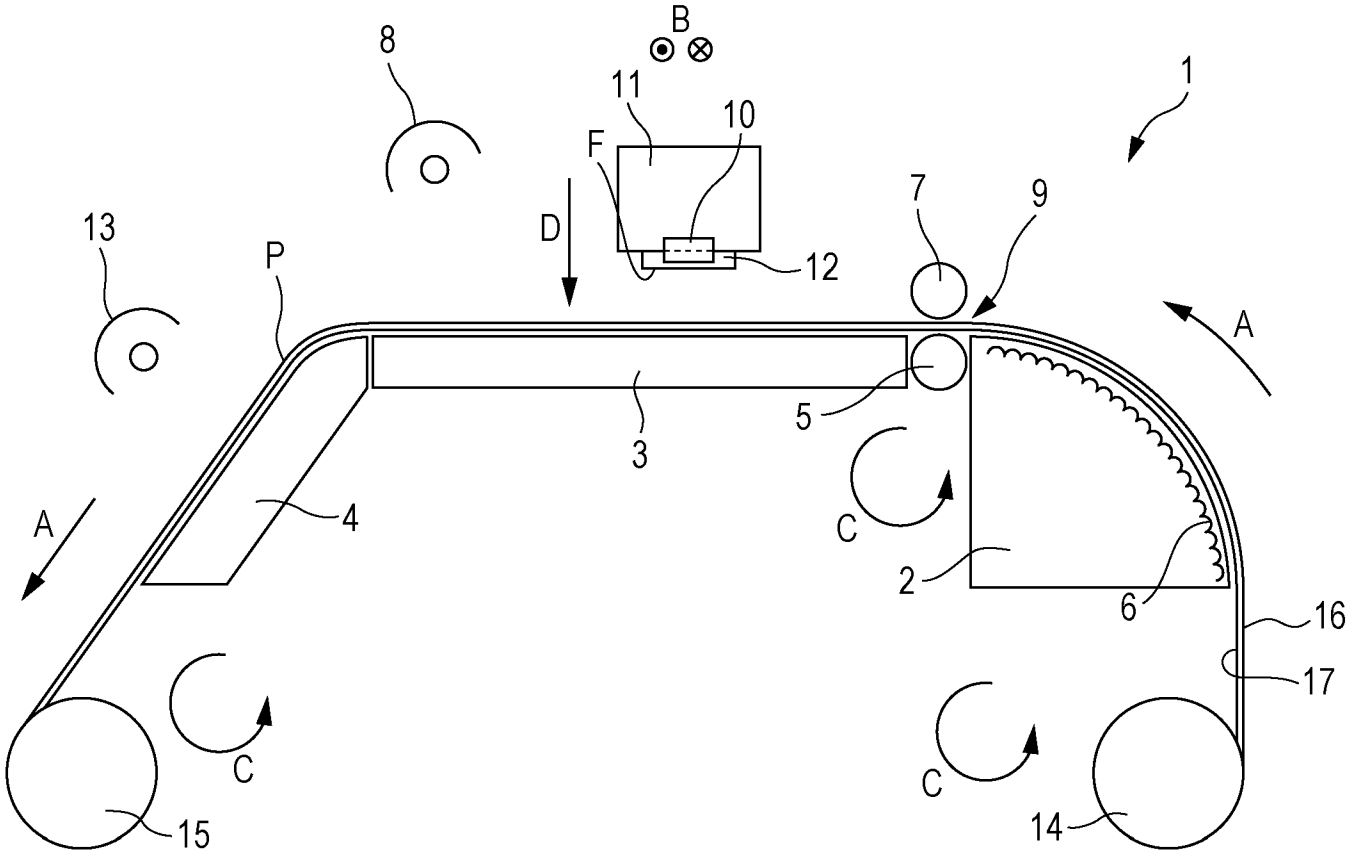
FIG. 1 is a schematic side view of a recording apparatus according to a first embodiment of the invention.

FIG. 1 is a schematic side view of a recording apparatus 1 according to the first embodiment of the invention. As shown in FIG. 1, the recording apparatus 1 transports a recording medium (medium) P in a transport direction A from a setting section 14 for setting the recording medium P to a winding section 15 for winding the recording medium P via a platen 2, a platen 3, and a platen 4 that are support sections of the recording medium P. In other words, the transport route of the recording medium P in the recording apparatus 1 extends from the setting section 14 to the winding section 15, and the support section of the recording medium P includes the platen 2, the platen 3, and the platen 4, which platens are provided on the transport route. The setting section 14 rotates in a rotation direction C to send the recording medium P. The winding section 15 rotates in the rotation direction C to wind the recording medium P. Depending on the arrangement, the rotation directions can be clockwise or counter-clockwise and the perceived direction may depend on perspective.

The recording apparatus 1 according to the embodiment can perform recording onto the recording medium P having a roll shape. The recording medium P is unrolled such that the portion of the recording medium on which recording is performed may be flat or substantially flat or unrolled.

However, the structure is not limited to this example, and a structure in which recording onto a recording medium of a sheet shape can be performed may be provided. In this structure in which recording onto the medium of the sheet shape can be performed, for example, a paper feed (transport) tray or a paper feed (transport) cassette may be used as the setting section 14 for the recording medium P. Furthermore, as the section for collecting the recording medium P, other than the winding section 15, for example, a reception section for discharge, a paper discharge (discharge) tray, or a paper discharge (discharge) cassette may be used.

In this embodiment, the rolled recording medium P that has been wound such that a recording surface 16 is the outside surface is used. Consequently, the rotation shaft of the setting section 14 is rotated in the rotation direction C to send the recording medium P from the setting section 14. Meanwhile, in a case where a recording medium P that has been wound such that the recording surface 16 is the inside surface is used, the rotation shaft of the setting section 14 can be rotated in the reverse direction of the rotation direction C to send the recording medium P. Similarly, the winding section 15 according to this embodiment winds the recording medium P such that the recording surface 16 is the outside surface, and the rotation shaft of the winding section 15 is rotated in the rotation direction C. In a case where the recording medium P is wound such that the recording surface 16 is the inside surface, the rotation shaft of the winding section 15 can be rotated in the reverse direction of the rotation direction C to wind the recording medium P.

The platen 2 of the recording apparatus 1 includes a heater 6. The heater 6 is used to heat (i.e., preheat) the recording medium P before recording is performed with recording heads 12 that serve as a recording section. The recording apparatus 1 preheats the recording medium P with the heater 6 from the side of a surface 17 that is opposite to the recording surface 16 of the recording medium P. Alternatively, for example, using a heater capable of heating the recording medium P by irradiating the recording medium P with infrared rays from the side of the recording surface 16 of the recording medium P, the recording medium P may be preheated from the side of the recording surface 16.

The recording apparatus 1 includes a drive roller 5 between the platen 2 and the platen 3. The drive roller 5 includes a rotation shaft that is provided in intersecting directions B which intersect the transport direction A. The drive roller 5 applies a sending force to the surface 17 of the recording medium P. A driven roller 7 that includes a rotation shaft that is provided in the intersecting directions B is disposed at a position opposite to the drive roller 5. The drive roller 5 and the driven roller 7 are a roller pair and can nip the recording medium P. With this structure, the drive roller 5 and the driven roller 7 serve as a transport section 9. The driven roller 7 rotates with the transport of the recording medium P. The drive roller 5 rotates in the rotation direction C to transport the recording medium P in the transport direction A, and the driven roller 7 rotates in the reverse direction of the rotation direction C.

The recording apparatus 1 includes recording heads 12 that serve as a liquid discharge section. The recording heads 12 are located opposite the platen 3. The recording apparatus 1 forms a desired image by discharging ink I (see FIGS. 5A and 5B and FIGS. 6A and 6B), which is an example of a liquid, toward the recording medium P from a nozzle forming surface F of the recording heads 12 in a direction D (a direction from the nozzle forming surface F toward the recording medium P, in this embodiment, a vertical downward direction) while the recording heads 12 are reciprocated in the intersecting directions B via a carriage 11. This structure enables the recording heads 12, as the liquid discharge section, to discharge the ink I (the liquid) toward the recording medium P. The recording heads 12, according to the embodiment, can discharge a black ink, a cyan ink, a magenta ink, and a yellow ink. The inks I contain respective anionic color materials. In other words, the recording apparatus uses the inks I that contain the anionic color materials as agglomerate components. Although the liquids (inks I) used in this embodiment contain the anionic color materials as the agglomerate components, the agglomerate components contained in the liquids or ink I according to the embodiment of the invention are not limited to the anionic color materials. Alternatively, the agglomerate components may be components other than the coloring materials (pigments or dyes), or may be cationic components.

In this embodiment, the carriage 11 includes a pretreatment agent supplying section 30 (see FIG. 3 and FIG. 4) that can discharge (supply) a pretreatment agent toward the recording medium P prior to the discharge of the inks I from the recording heads 12. Although not shown in FIG. 1, a detailed description of the pretreatment agent supplying section 30 will be made below. The specific structure of the recording heads 12 and the specific structure of the pretreatment agent supplying section 30 will be described below.

The carriage 11 also includes an ionizer 10 that produces positive ions that have a polarity opposite to the polarity of the anionic color materials (negatively charged agglomerate components) which are the agglomerate components. The ionizer 10 can supply positive ions in the direction D, and serves as an ion supplying section. The ionizer 10 according to the embodiment is a corona discharge type ionizer. The type of the ion supplying section is not limited to a specific one.

In other words, the recording apparatus 1 according to the embodiment includes the recording heads 12 that discharge the inks I that contain the color materials having a polarity toward the recording medium P. The ionizer 10 serves as the ion supplying section that supplies ions having a polarity opposite to that of the color materials toward the inks I discharged on the recording medium P. Consequently, as will be described in detail below, a skin layer H (see FIGS. 6A and 6B) can be formed by agglomerating the color materials, which are agglomerate components, with the ions on the surface of each dot of the inks I discharged on the recording medium P. The formed skin layer H can prevent each dot of the inks I discharged on the recording medium P from exceeding a desired size and can prevent the dots from coming into contact with each other. With this structure, the unevenness due to contact of the dots of the inks I discharged onto the recording medium P can be suppressed. For example, the "agglomerate components that have a polarity" may be the coloring materials (pigments or dyes) in the case where the liquid is the inks I as in this embodiment, or polymer components such as latex. Here, the anionic components are the negatively charged components, and the cationic components are the positively charged components. However, as described above, the "agglomerate components that have a polarity" are not limited to a specific component. Furthermore, for example, the "ion supplying section that supplies ions having a polarity opposite to that of the agglomerate components" is the ionizer 10 as in this embodiment, and the like, and the ionizer 10 is capable of supplying positive ions if the agglomerate components are anionic color materials. That is, the structural component is a component that can supply ions having a polarity that counters ions of the "agglomerate components that have a polarity". In other words, the polarity of the ions may be opposite the polarity of the agglomerate components. However, the ion supplying section is not limited to the ionizer 10, and a component other than the ionizer 10 may be used.

A heater 8 is provided at a position downstream of the recording heads 12 in the transport direction A. The heater 8 serves as a heating section that can emit infrared rays toward an area on which recording is or has been performed with the recording heads 12. The heater 8 dries each dot of the inks I on which the skin layer H has been formed. The heater 8 according to the embodiment is disposed at a position opposite the platen 3. The heater 8 may be an infrared heater that can heat the recording surface 16 of the recording medium P. However, the heater 8 is not limited to the infrared heater and any suitable a heater that can heat the recording medium P from the platen 3 side (the surface 17 side) may be used.

Furthermore, a heater 13 that can emit infrared rays is provided at a position downstream of the heater 8 in the transport direction A of the recording medium P. The heater 13 according to the embodiment is disposed at a position opposite the platen 4. The heater 13 may be an infrared heater that can heat the recording surface 16 of the recording medium P. However, the heater 13 is not limited to the infrared heater and any suitable heater that can heat the recording medium P from the platen 4 side (the surface 17 side) may be used. Furthermore, for example, instead of the heating device such as the infrared heater, an air blower or the like, such as a fan, may be used.

Figure 2:
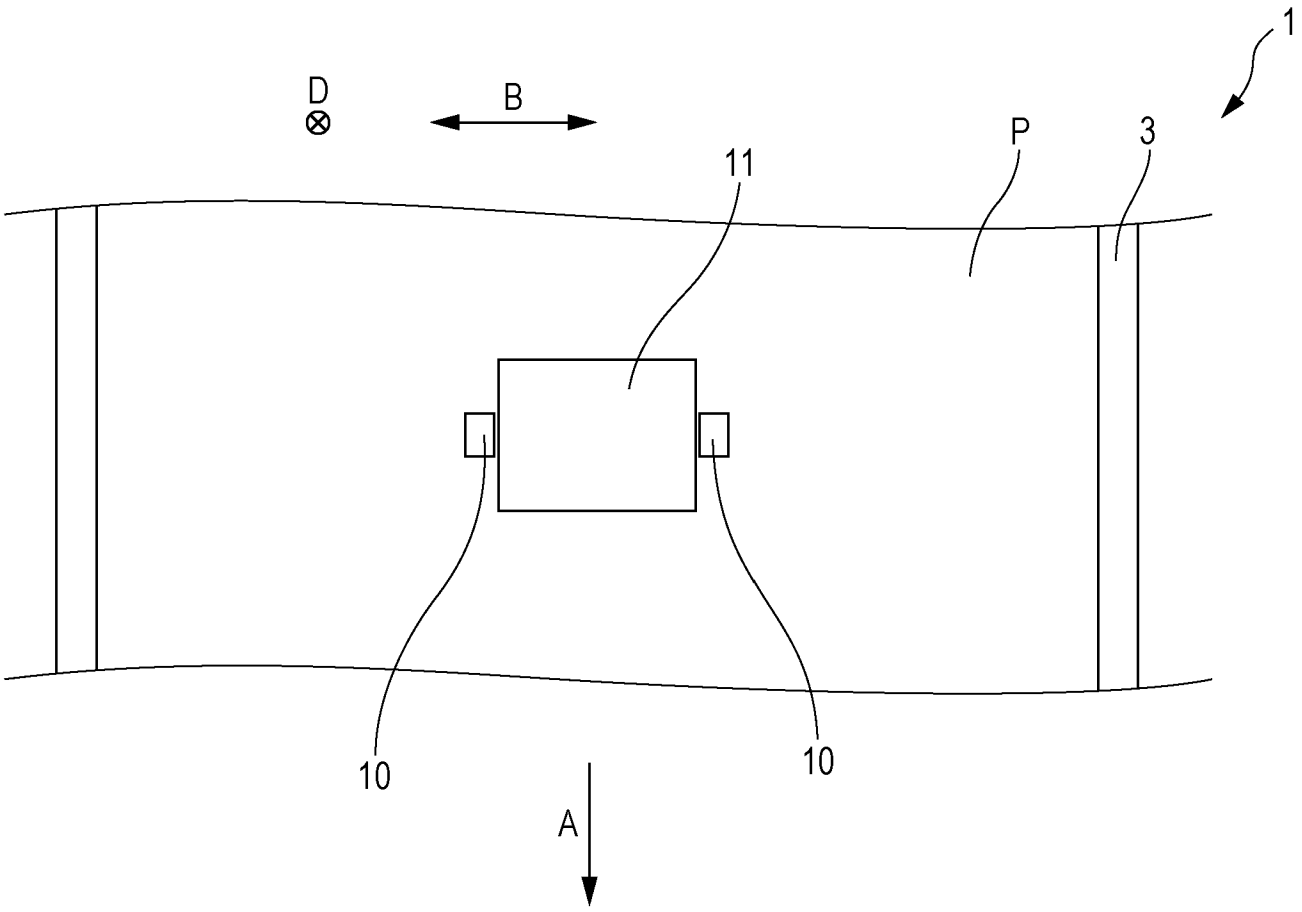
FIG. 2 is a schematic plan view of main components of the recording apparatus according to the first embodiment of the invention.
Figure 3:
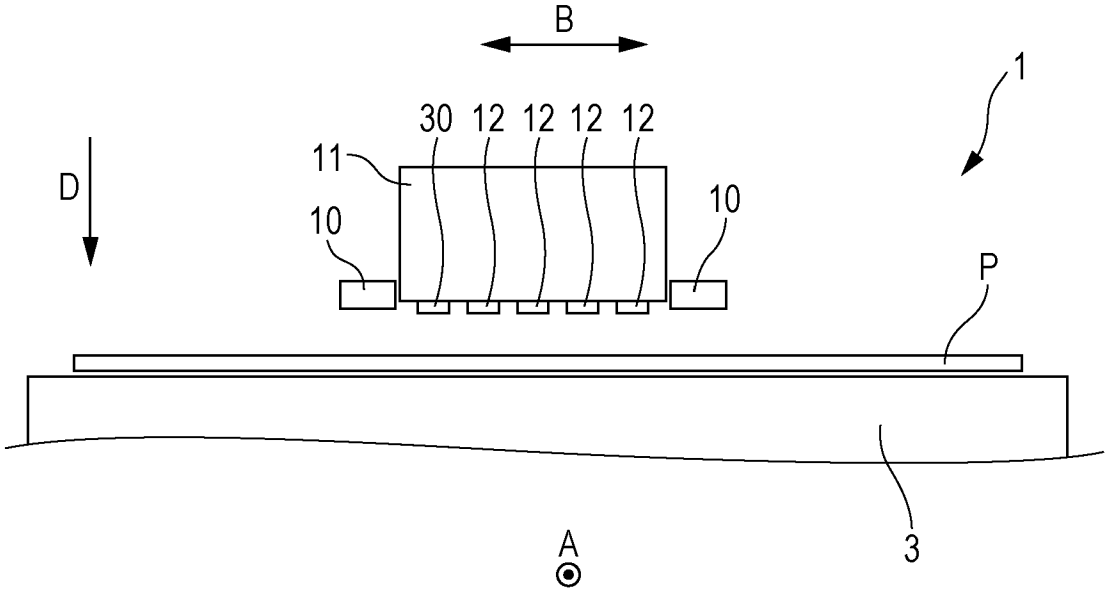
FIG. 3 is a schematic front view of the main components of the recording apparatus according to the first embodiment of the invention.
Figure 4:
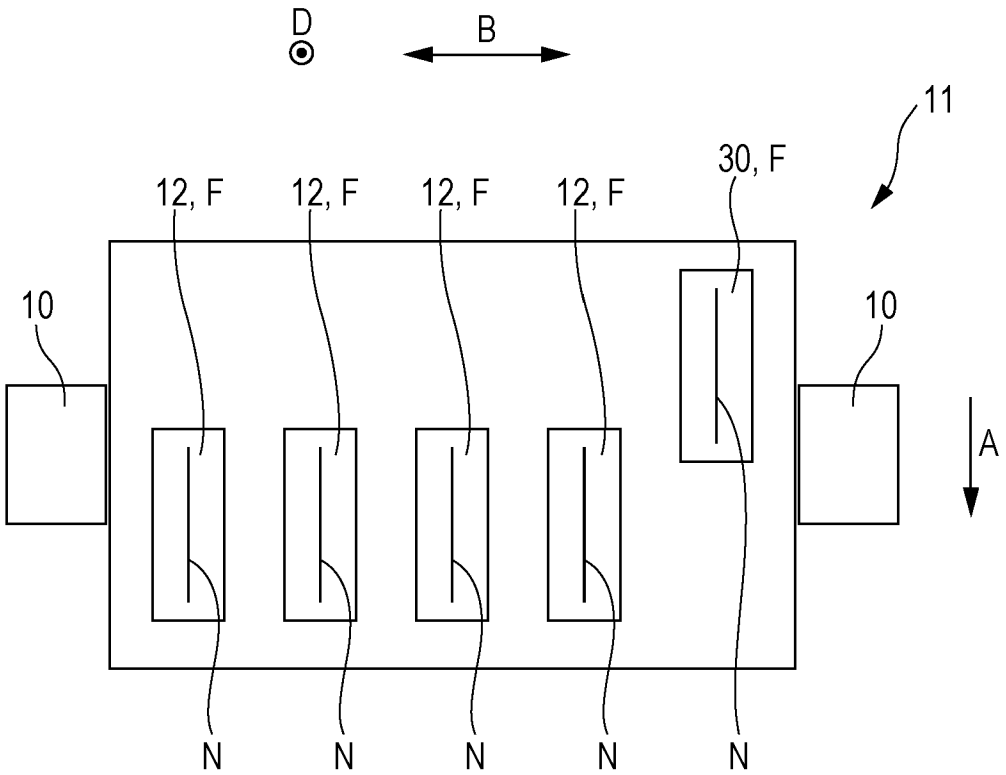
FIG. 4 is a schematic bottom view of the main components of the recording apparatus according to the first embodiment of the invention.

The carriage 11 is a main component of the recording apparatus 1 according to the embodiment and will now be described. FIG. 2 is a schematic plan view of the carriage 11 according to the embodiment. FIG. 3 is a schematic front view of the carriage 11. FIG. 4 is a schematic bottom view of the carriage 11. The carriage 11 according to the embodiment includes ionizers 10 at both ends in the intersecting directions B of the carriage 11 as shown in FIG. 2 to FIG. 4. The carriage 11 includes four recording heads 12 and the pretreatment agent discharge head 30 on the surface opposite the recording medium P as shown in FIG. 3 and FIG. 4. The recording heads 12 discharge four colors of inks I; a black ink, a cyan ink, a magenta ink, and a yellow ink, respectively in one example. The pretreatment agent discharge head 30 serves as a pretreatment agent supplying section that discharges a pretreatment agent that contains components (i.e., cationic components) having a polarity opposite to that of the color materials. As shown in FIG. 4, the four recording heads 12 and the pretreatment agent discharge head 30 have similar structures, and discharge one of the inks I and the pretreatment agent from the nozzle array N provided on the nozzle forming surface F, respectively. The structure of the pretreatment agent supplying section is not limited to this example, and alternatively, for example, a spray ejection type component or a roller type component may be used.

As described above, the recording apparatus 1 according to the embodiment includes the transport section 9 that transports the recording medium P. The carriage 11 reciprocates together with the recording heads 12 in the intersecting directions B which intersect the transport direction A of the recording medium P. As shown in FIG. 1 to FIG. 4, the ionizers 10 are provided on the carriage 11. In other words, the recording apparatus 1 according to the embodiment is a serial type liquid discharge apparatus that includes the liquid discharge section. The liquid discharge section moves in the intersecting directions B which intersect the transport direction A. The ionizers 10 that serve as the ion supplying sections are provided on the carriage 11 that serves as a moving section. With this structure, immediately after the inks I are discharged toward the recording medium P, the ions can be supplied. Consequently, the unevenness caused by contact of the dots of the inks I discharged on the recording medium P can be effectively suppressed.

Furthermore, as shown in FIG. 3 and FIG. 4, on the carriage 11 that moves in the intersecting directions B, the ionizers 10 are arranged in the intersecting directions B together with the recording heads 12. During a recording operation (operation during which the inks I are discharged), one of the ionizers 10 on the downstream side of the moving direction of the recording heads 12 discharging the inks I among the intersecting directions B is driven under the control of a controller 18 (see FIG. 7), which will be described below. In other words, in the recording apparatus 1 according to the embodiment, with respect to the recording heads 12, the ionizers 10 are provided on the downstream sides of the moving directions of the recording heads 12 discharging the inks I among the intersecting directions B, respectively. With this structure, the structure capable of supplying ions to the inks I discharged on the recording medium P, i.e., the structure capable of supplying the ions toward the inks I discharged on the recording medium P after the inks I have been discharged onto the recording medium P from the recording heads 12 can be readily provided. The ion supplying section (ionizers 10) according to the embodiment is provided, with respect to the liquid discharge section (recording heads 12), on the downstream side of the moving direction of the liquid discharge section discharging the liquid among the intersecting directions B.

Alternatively, as in a third embodiment described below, the ion supplying section may be provided on the downstream side in the transport direction A, with respect to the liquid discharge section. With such a structure, also, the structure capable of supplying the ions toward the liquid discharged on the medium after the liquid is discharged onto the medium from the liquid discharge section can be readily provided.

Furthermore, as shown in FIG. 3 and FIG. 4, the ionizers 10 according to the embodiment are provided at both ends in the intersecting directions B, with respect to the recording heads 12. Consequently, in both directions of the intersecting directions B, while the inks I are being discharged, the ions can be supplied to the discharged inks I. In other words, this structure enables recording in both directions, and the unevenness due to contact of the dots of the inks I discharged on the recording medium P can be suppressed with high productivity. Furthermore, as in this embodiment, the recording heads 12 and the ionizers 10 that are arranged in the intersecting directions B enable ions to be supplied immediately after the discharge of the inks I. Furthermore, the controller 18 according to the embodiment can drive, between the ionizers 10 that are provided at two sides in the intersecting directions B with respect to the recording heads 12, only one of the ionizers 10 on the downstream side in the moving direction of the recording heads 12 that are discharging the inks I in the recording, and stop the driving of the other one of the ionizers 10 on the upstream side. Thus, the controller 18 can operate the ionizer 10 that is downstream of the direction in which the recording heads are moving while stopping or pausing the ionizer 10 that is upstream of the direction in which the recording heads are moving. This allows the ions to be discharged after the ink is discharged. However, the controller can cause both ionizers to operate at the same time, cause only the downstream ionizer to operate, or cause only the upstream ionizer to operate. This drive control can suppress, for example, uneven charging on the recording medium P, pretreatment agent rejection, and an increase in transportation loads due to increased frictional force caused by unnecessary charging of the recording medium P due to the ions produced by the ionizer 10 on the upstream side prior to ink discharge. In a case where an unevenly charged recording medium P is to be used, however, the controller 18 according to the embodiment may perform recording while driving the ionizer 10 on the upstream side to suppress the uneven charging.

Furthermore, as shown in FIG. 3 and FIG. 4, the recording apparatus 1 according to the embodiment includes the pretreatment agent discharge head 30 that serves as a pretreatment agent supplying section. The pretreatment agent discharge head 30 supplies, prior to the discharge of the inks I, the pretreatment agent containing components (positively charged cationic components) having a polarity opposite to that of the color materials (negatively charged anionic color materials) that are agglomerate components of the inks I to the recording medium P. Consequently, the effect of suppressing the spread of the dots of the inks I can be further increased. Although the principle behind the effective suppression of the spread of the dots of the inks I has not been specifically determined, for example, it can be assumed that the ions supplied by the ionizers 10 form the skin layer H on an upper side of the surface of the dot of the ink I, while the pretreatment agent supplied to the recording medium P prior to the discharge of the ink I reacts with the ink I to form an agglomerated portion (fixed portion of the coloring materials) where the agglomerate components are agglomerated in a lower side of the dot of the ink I. Consequently, the spread of the dots can be effectively suppressed, and the unevenness due to contact of the dots of the inks I discharged on the recording medium P can be effectively suppressed. Furthermore, the controller 18 according to the embodiment can stop the driving of the pretreatment agent discharge head 30 during the recording operation depending on the type of recording medium P to be used. This is because, in some cases, depending on the type of recording medium P, due to the supplied pretreatment agent, the abrasion resistance characteristic of the ink discharged on the recording medium P may be reduced. For example, a reduction (a reduction in the anchor effect) in the level of penetration of the ink I into the recording medium P).

Figure 5A:
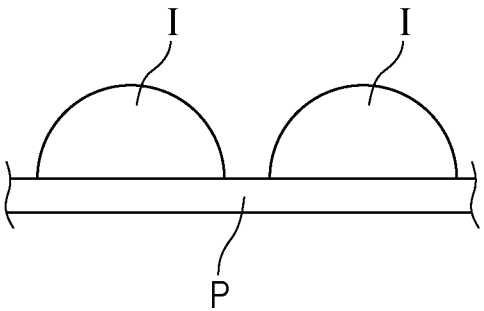
FIGS. 5A and 5B show the unevenness caused by contact of liquid dots discharged onto a medium.
Figure 5B:
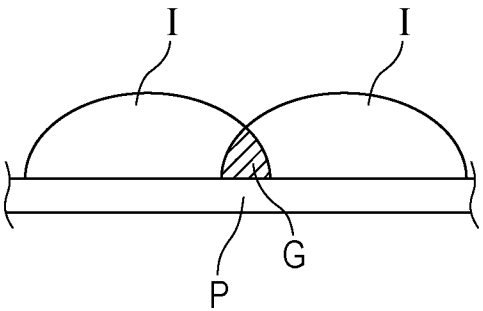
Figure 6A:
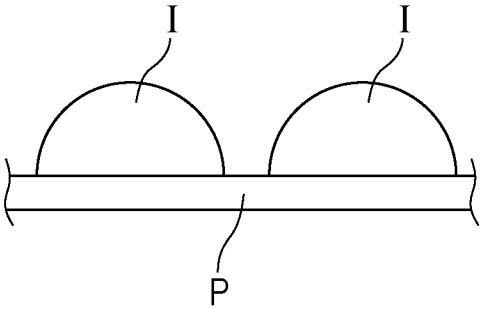
FIGS. 6A and 6B show a state in which the unevenness caused by contact of the liquid dots discharged onto the medium is suppressed.
Figure 6B:
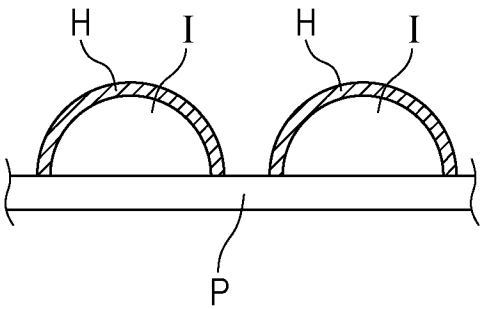

Now, the unevenness due to contact of the dots of the inks I discharged on the recording medium P, and the skin layer H that can suppress the unevenness formed on the surface of the dots of the inks I will be described. FIGS. 5A and 5B and FIGS. 6A and 6B show the dots of the inks I formed adjacent to each other on the recording medium P. FIG. 5A and FIG. 6A show the dots of the inks I immediately after the ink is discharged onto the recording medium P, and FIG. 5B and FIG. 6B show the dots of the inks I some time after the ink has been discharged onto the recording medium P.

In a traditional recording apparatus, after the inks I are discharged on the recording medium P as shown in FIG. 5A, the dots of the inks I come into contact with each other as shown in FIG. 5B, and the contact portion G causes uneven agglomeration of agglomerate components in the other portions. This may cause uneven agglomeration over the image (liquid discharged product) formed on the recording medium P.

In contrast, in the recording apparatus 1 according to the embodiment, after the inks I are discharged on the recording medium P as shown in FIG. 6A, the skin layer H is formed on the surface of each dot of the inks I as shown in FIG. 6B. The skin layer H is formed by applying ions having a polarity opposite to that of the agglomerate components on the surface of the dots of the inks I. Thereby the agglomerate components on the surface of the dots of the inks I substantially evenly agglomerate in a film state. Consequently, the contact of or between the dots of the ink I can be suppressed as shown in FIG. 6B, and uneven agglomeration in the image (liquid discharged product) formed on the recording medium P can be suppressed. The "suppression of unevenness" includes, for example, a case where granularity in an image evenly formed with the ink I is reduced, and a case where a color difference ($\Delta E$: $(a^{*2}+b^{*2}+L^{*2})^{1/2}$ in a L*a*b* color space) is made to be 2 or less.

As described above, the recording apparatus 1 according to the embodiment includes the pretreatment agent discharge head 30 that discharges (supplies) the pretreatment agent containing components having a polarity opposite to that of the color materials toward the recording medium P prior to the discharge of the inks I, the transport section 9 for the recording medium P, and the carriage 11 that reciprocates in the intersecting directions B together with the recording heads 12. The carriage 11 is provided with the ionizers 10 and the pretreatment agent discharge head 30. As shown in FIG. 4, the ionizers 10 are provided on the downstream sides of the moving directions of the recording heads 12 discharging the inks I among the intersecting directions B, with respect to the recording heads 12, respectively. The pretreatment agent discharge head 30 is provided on the upstream side of the transport direction A with respect to the recording heads 12. In other words, the recording apparatus 1 according to the embodiment is a so-called serial type liquid discharge apparatus, and the moving section includes the ion supplying section and the pretreatment agent supplying section. With this structure, immediately after the pretreatment agent is discharged toward the recording medium P, the inks I are discharged toward the recording medium P. Immediately after the ink application, the ions can be supplied. Consequently, unevenness caused by contact of or between the dots of the inks I discharged on the recording medium P can be effectively suppressed. The pretreatment agent supplying section (pretreatment agent discharge head 30) according to the embodiment is provided on the upstream side of the transport direction A with respect to the liquid discharge section (recording heads 12). The pretreatment agent supplying section may be, as in the second embodiment described below, on the upstream side of the moving direction of the liquid discharge section discharging the liquid among the intersecting directions B with respect to the liquid discharge section. Such a structure is capable of supplying the pretreatment agent toward the medium and then discharging the liquid from the liquid discharge section toward the medium. Consequently, after the pretreatment agent is discharged toward the medium, the liquid is discharged toward the medium. Then, the ions can be supplied. Accordingly, the unevenness caused by contact of the liquid dots discharged on the medium can be effectively suppressed.

As shown in FIG. 4, the pretreatment agent discharge head 30 according to the embodiment is provided on the upstream side of the transport direction A with respect to the recording heads 12. Consequently, in both of the intersecting directions B, while the pretreatment agent is being supplied, the inks I can be discharged. In other words, this structure enables recording in both directions, and the unevenness due to contact of the dots of the inks I discharged on the recording medium P can be suppressed with high productivity. Furthermore, with a single pretreatment agent discharge head 30, the necessity for providing the pretreatment agent supplying sections at two sides (i.e., two pretreatment agent supplying sections) of the recording heads 12 can be eliminated. Consequently it is possible to constrain both the size (or suppress the increase in size) of the apparatus and the cost of the apparatus.

Figure 7:
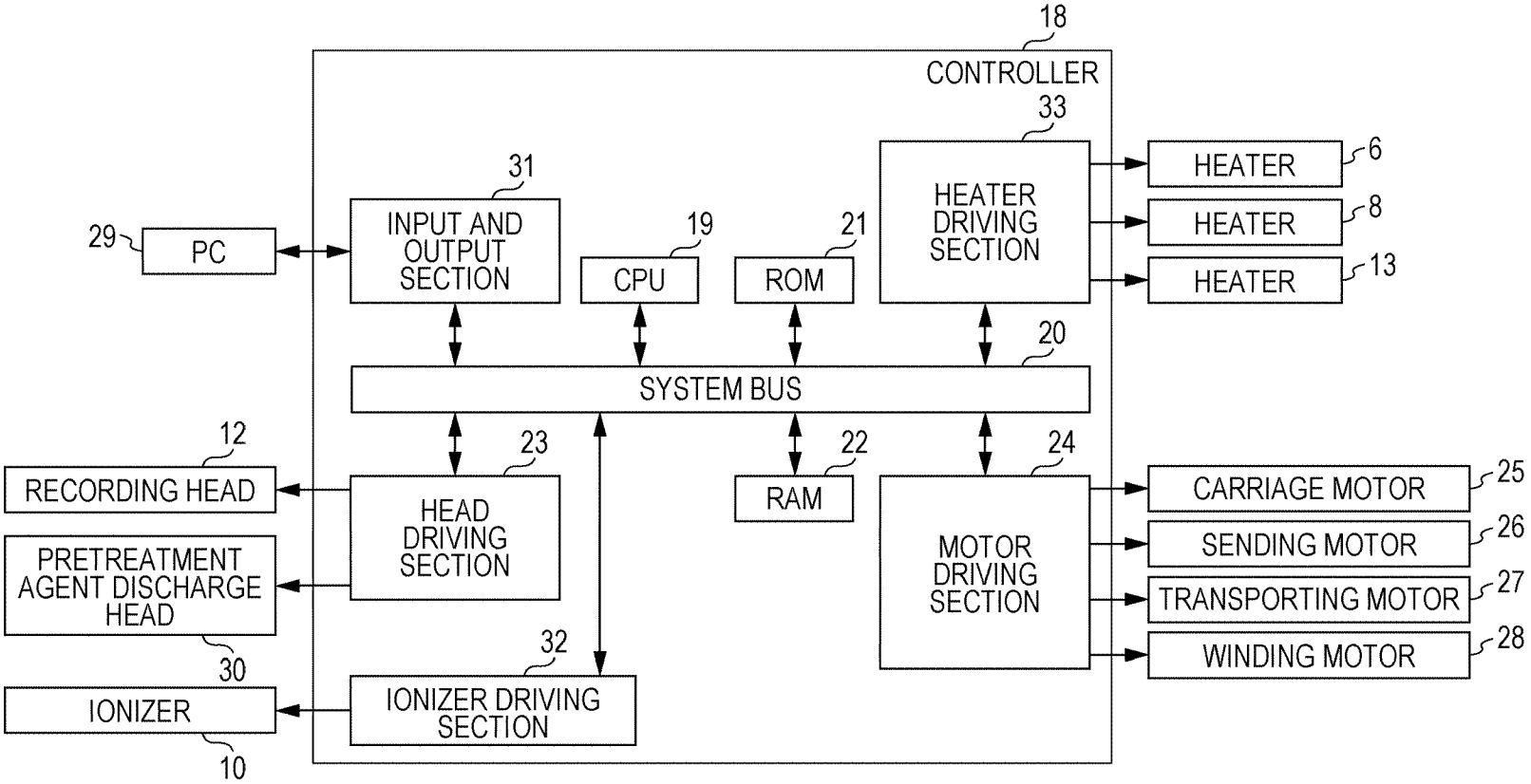
FIG. 7 is a block diagram of the recording apparatus according to the first embodiment of the invention.

An electric configuration in the recording apparatus 1 according to the embodiment will be described. FIG. 7 is a block diagram of the recording apparatus 1 according to the embodiment. The controller 18 includes a central processing unit (CPU) 19 that performs overall control of the recording apparatus 1. The CPU 19 is connected to a read-only memory (ROM) 21 that stores various control programs to be executed by the CPU 19 and a random access memory (RAM) 22 that can temporarily store data via a system bus 20.

The CPU 19 is also connected to a head driving section 23 that drives the recording heads 12 and the pretreatment agent discharge head 30 via the system bus 20. The CPU 19 is also connected to a motor driving section 24 that drives a carriage motor 25 that moves the carriage 11, a sending motor 26 that is a drive source of the setting section 14, a transporting motor 27 that is a drive source of the drive roller 5, and a winding motor 28 that is a drive source of the winding section 15 via the system bus 20. The CPU 19 is also connected to a heater driving section 33 that drives the heaters 6, 8, and 13 via the system bus 20. The CPU 19 is also connected to an ionizer driving section 32 that drives the ionizers 10 via the system bus 20. Furthermore, the CPU 19 is also connected to an input and output section 31 via the system bus 20. The input and output section 31 is connected to a personal computer (PC) 29 that is an external device that is used to input recording data or the like to the recording apparatus 1.

The recording apparatus 1 according to the embodiment can form a plurality of layers of the inks I by discharging the inks I from the recording heads 12 under recording control of the recording heads 12 and drive control of the components such as transport control of the drive roller 5 (transport section 9) by the controller 18. For example, in a case where the recording apparatus 1 includes the pretreatment agent supplying section and is capable of forming a plurality of layers by discharging the inks I from the recording heads 12, the recording apparatus 1 discharges the inks I (forms a plurality of layers of the inks I) to layer a plurality of ink layers on an area to which the pretreatment agent has been supplied.

Consequently, with the recording apparatus of such a structure, it is difficult to suppress the unevenness due to contact of the dots of the inks I discharged on the recording medium P. This is because the pretreatment agent does not fully work on the upper layers of the inks I. In contrast, the recording apparatus 1 according to the embodiment includes the ionizers 10 that supply ions having a polarity opposite to that of the agglomerate components included in the inks I discharged on the recording medium. Consequently, the unevenness caused by contact of the liquid dots discharged on the medium can be suppressed. Specific examples of forming a plurality of layers of the inks I by discharging the inks I from the recording heads 12 include, for example, forming an image that can be viewed from both front and back sides of the recording medium P by using a transparent medium as the recording medium P. In such a case, ink layers of the inks I to be seen from the front surface and ink layers of the inks I to be seen from the back surface can be formed. In one example, a shielding layer of a white ink may be further formed between the layers.

Figure 8:
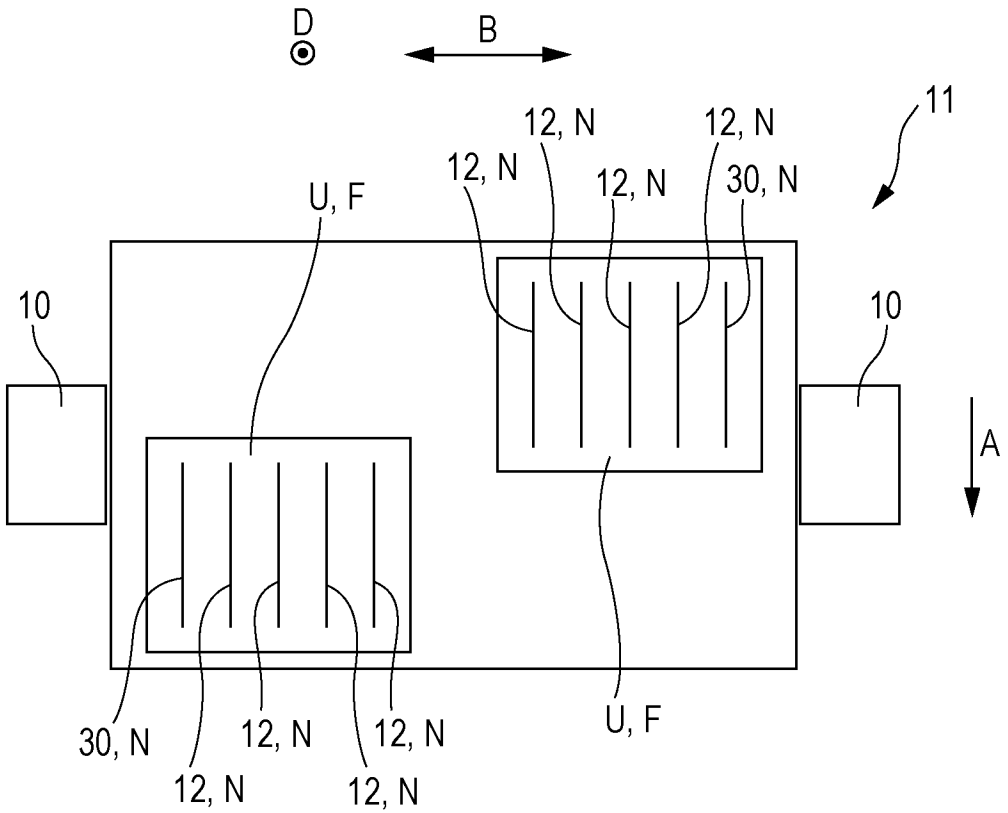
FIG. 8 is a schematic bottom view of main components of a recording apparatus according to a second embodiment of the invention.

Second Embodiment (FIG. 8)

Now, a recording apparatus according to the second embodiment will be described in detail with reference to the attached drawings. FIG. 8 is a schematic bottom view of main components of the recording apparatus 1 according to the embodiment. Components that are common to the above-described first embodiment are shown with the same reference numerals, and detailed descriptions of the components are omitted. The recording apparatus 1 according to the embodiment other than the carriage 11 has a structure similar to that of the recording apparatus 1 according to the first embodiment.

The recording apparatus 1 according to the first embodiment includes, as shown in FIG. 4, the carriage 11 that is provided with the four recording heads 12 that correspond to the four inks I respectively and a single pretreatment agent discharge head 30 on the bottom surface (the surface that is opposite the recording medium P) of the carriage 11. Meanwhile, the carriage 11 according to the embodiment includes, as shown in FIG. 8, on the bottom surface, two head units Us each including four recording heads 12 corresponding to the four inks I and a single pretreatment agent discharge head 30 in a staggered arrangement in the direction viewed from the intersecting directions B. In each head unit U, the recording heads 12 and the pretreatment agent discharge head 30 are arranged such that the pretreatment agent discharge head 30 is at an outermost position in the carriage 11 with respect to the recording heads 12 in the intersecting directions B.

In other words, the recording apparatus 1 according to the embodiment includes the pretreatment agent discharge heads 30 that serve as the pretreatment agent supplying sections at both ends in the intersecting directions B with respect to the recording heads 12 that serve as the liquid discharge section. Consequently, in both of the intersecting directions B, the inks I can be discharged while the pretreatment agent is being supplied. That is, this structure enables recording in both directions, and the unevenness due to contact of the dots of the inks I discharged on the recording medium P can be suppressed with high productivity. Furthermore, as in this embodiment, the liquid discharge section (recording heads 12) and the pretreatment agent supplying sections (pretreatment agent discharge heads 30) that are arranged in the intersecting directions B enable the ion supply to supply ions immediately after the discharge of the inks I.

Figure 9:
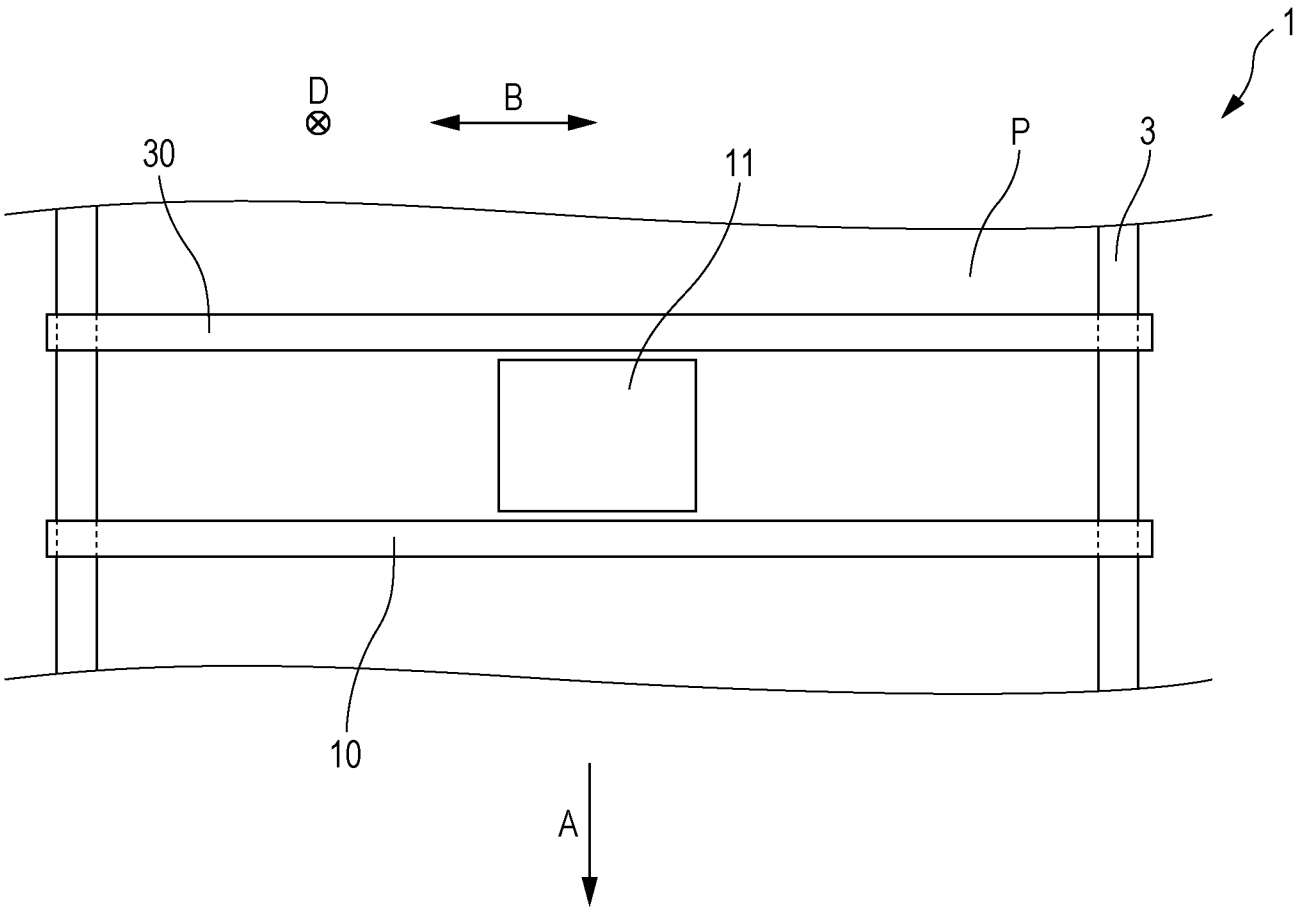
FIG. 9 is a schematic plan view of main components of a recording apparatus according to a third embodiment of the invention.

Third Embodiment (FIG. 9)

A recording apparatus according to the third embodiment will be described in detail with reference to the attached drawings. FIG. 9 is a schematic plan view of main components of the recording apparatus 1 according to the embodiment. Components that are common to the above-described first and second embodiments are shown with the same reference numerals, and detailed descriptions of the components are omitted. The recording apparatus 1 according to the embodiment has a structure similar to that of the recording apparatus 1 according to the first embodiment other than the carriage 11, the ionizers 10, and the pretreatment agent discharge head 30.

The recording apparatus 1 according to the first embodiment includes, as shown in FIG. 2 to FIG. 4, the carriage 11 that is provided with the ionizers 10 and the pretreatment agent discharge head 30. Meanwhile, the recording apparatus 1 according to the embodiment includes, as shown in FIG. 9, the ionizer 10 and the pretreatment agent discharge head 30 provided separately from the carriage 11. Specifically, in the transport direction A, the line-head shaped pretreatment agent discharge head 30 is provided at a position on the upstream side of the carriage 11 (that is, the recording heads 12). The pretreatment agent discharge head 30 can discharge the pretreatment agent over the whole area in the intersecting directions B. Furthermore, the ionizer 10 is provided on the downstream side of the carriage 11 (that is, the recording heads 12). The ionizer 10 can supply ions having a polarity opposite to that of agglomerate components of the inks I to the inks I discharged on the recording medium P over the whole area in the intersecting directions B.

The recording apparatus 1 according to the embodiment includes the recording heads 12 that perform recording while reciprocating, however, the recording apparatus may include a so-called line head that has a plurality of nozzles for discharging the inks I in the intersecting directions B which intersect the transport direction A. The "line head" is a recording head configured such that the area of the nozzles formed in the intersecting directions B that intersect the transport direction A of the recording medium P can cover the whole area in the intersecting directions B of the recording medium P. The "line head" is used in a recording apparatus that forms an image by relatively moving the recording head or the recording medium P. Note that the area of the nozzles of the line head in the intersecting directions B may not cover the whole area of the recording media P usable in the recording apparatus in the intersecting directions B.

It is to be understood that the present invention is not limited to the above-described embodiments, various modifications can be made within the scope of the following claims, and these modifications are included within the scope of the invention.

What is claimed is:

1. A liquid discharge apparatus comprising:

a liquid discharge section for discharging a toward a medium, the liquid containing agglomerate components having a polarity;

at least one ion supplying section for supplying ions to the liquid discharged on the medium, the ions supplied by the ion supplying section having a polarity opposite to that of the agglomerate components contained in the liquid;

a pretreatment agent supplying section for supplying a pretreatment to the medium prior to the discharge of the liquid, the pretreatment agent containing components having the polarity opposite to that of the agglomerate components contained in the liquid;

a transport section for transporting the medium; and a moving section configured to reciprocate together with the liquid discharge section in directions intersecting a transport direction of the medium, wherein the pretreatment agent supplying section is provided on the moving section, wherein the pretreatment agent supplying section is provided on at least one of upstream of the liquid discharge section in the transport direction and upstream of the liquid discharge section in the moving direction of the liquid discharge section discharging the liquid among the intersecting directions, and wherein the ion supplying section is disposed above the transported medium.

2. The liquid discharge apparatus according to claim 1, wherein the ion supplying section is provided on the moving section.

3. The liquid discharge apparatus according to claim 2, wherein the ion supplying section is provided downstream side of the liquid discharge section in the moving direction of the liquid discharge section discharging the liquid among the intersecting directions with respect to the liquid discharge section.

4. The liquid discharge apparatus according to claim 2, wherein the at least one ion supplying section includes two ion supplying sections that are provided on two sides of the liquid discharge section in the intersecting directions with respect to the liquid discharge section.

5. The liquid discharge apparatus according to claim 1, wherein the ion supplying section is provided downstream of the liquid discharge section in the transport direction of the medium.

6. The liquid discharge apparatus according to claim 1, wherein the at least one pretreatment agent supplying section includes two pretreatment agents that are provided so that the liquid discharge section positions between the two pretreatment agents in the intersecting directions with respect to the liquid discharge section.

7. The liquid discharge apparatus according to claim 1, wherein the pretreatment agent supplying section is provided upstream of the liquid discharge section in the transport direction with respect to the liquid discharge section.

8. The liquid discharge apparatus according to claim 1, wherein the liquid discharge apparatus can form a plurality of layers by discharging the liquid from the liquid discharge section.

9. The liquid discharge apparatus according to claim 1, wherein the pretreatment agent supplying section is offset from the liquid discharge section in a transport direction of the medium.

* * * * *